United States Patent [19]

Grubbs

[11] 4,012,876

[45] Mar. 22, 1977

[54] HALF-LOG WALL CONSTRUCTION

[76] Inventor: George B. Grubbs, P.O. Box 1, Pinola, Miss. 39149

[22] Filed: Mar. 3, 1976

[21] Appl. No.: 663,349

[52] U.S. Cl. ..... 52/233; 46/20; 52/586

[51] Int. Cl.[2] ..... E04B 1/10

[58] Field of Search ..... 52/233, 586; 46/20

[56] References Cited

UNITED STATES PATENTS

| | | | |
|---|---|---|---|
| 1,445,738 | 2/1923 | Adams | 52/233 |
| 1,915,711 | 6/1933 | Adams | 52/233 |
| 1,953,460 | 4/1934 | Bernhard | 52/233 |
| 1,980,660 | 11/1934 | Bonn | 52/233 |
| 2,498,551 | 2/1950 | Tonsrud | 52/233 |
| 3,460,301 | 4/1969 | Davis | 52/233 |

FOREIGN PATENTS OR APPLICATIONS

| | | | |
|---|---|---|---|
| 33,743 | 1/1922 | Norway | 52/233 |
| 44,909 | 2/1917 | Sweden | 52/233 |

*Primary Examiner*—Price C. Faw, Jr.
*Assistant Examiner*—Henry Raduazo
*Attorney, Agent, or Firm*—Bacon & Thomas

[57] ABSTRACT

Heartwood cores, remaining after cutting veneer sheets from logs are sawn to provide half logs which are secured to a supporting structure to simulate a log building. The half logs are rabbetted at their edges and filler strips extend into the rabbets of adjacent half-logs. Each filler strip has an outwardly extending head wedged between acute angled edges of adjacent logs to provide an efficient weather seal.

2 Claims, 1 Drawing Figure

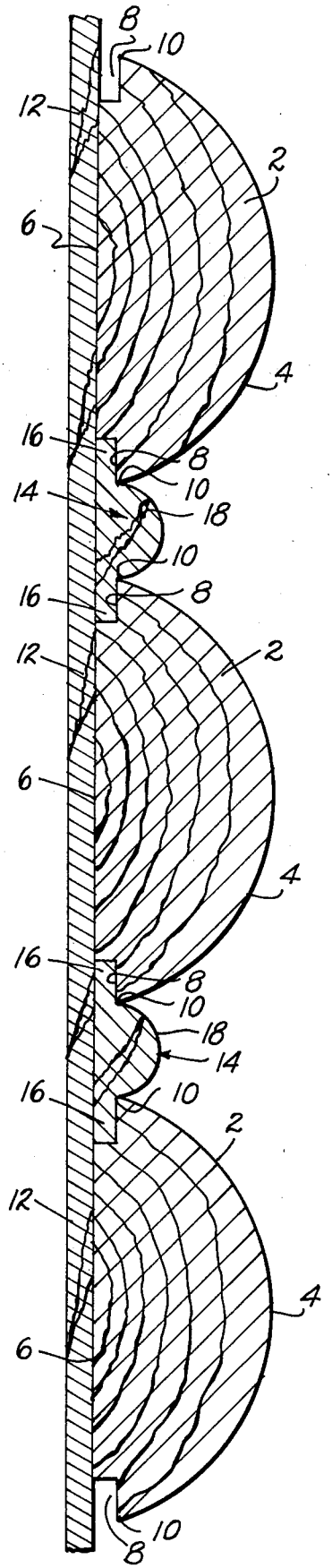
8
10
12
2
6
4
16
8
10
14
18
10
16
8
12
2
6
4
16
8
10
18
14
16
10
2
12
4
6
10
8

HALF-LOG WALL CONSTRUCTION

BACKGROUND OF THE INVENTION

This invention is in the field of building construction and particularly wooden structures resembling log buildings.

It has been proposed heretofore to construct simulated log buildings by employing half logs, that is, generally cylindrical wooden members slit longitudinally into semi cylindrical bodies and to arrange them with their flat sides coplanar and their cylindrical surfaces directed outwardly to simulate log buildings. Examples of such proposals are the U.S. patents to Adams Nos. 1,915,711, Jonsrud 2,498,551, and Dombrowski 2,619,686. The prior proposals recognized the difficulty of effecting a proper seal between adjacent half logs and proposed various ways of doing so. In Adams, the edges of the logs were rabbeted with filler strips extending into those rabbets but he found it necessary to provide additional weather seals, such as water resistant material or metal flashing. Jonsrud likewise provided the rabbets but discloses springs to press the filler strips against the forward edges of the rabbets in an effort to effect a proper seal. Dombrowski discloses the formation of grooves along the adjacent edges of the half logs with filler strips comprising flat members wedged into those grooves. The foregoing proposals all involved additional materials or expensive manufacturing operations and/or precise dimension controls to effect the necessary seals.

SUMMARY OF THE INVENTION

The present invention has for its principal object the construction of a simulated log building with highly effective but simple and economical sealing means between the half log members.

As is well known, veneers for forming plywood or the like have been customarily produced by cutting thin layers from a rotating log of wood. However, the logs cannot be cut below a certain diameter and the prior practice resulted in the accumulation of cores of heartwood. To avoid complete waste of the heartwood, which is usually denser and harder than the remainder of the log, some manufacturers have cut the cores into 2 × 4's that resulted in considerable waste of material. Applicant proposes to use those heartwood cores to form the materials for the present invention.

BRIEF DESCRIPTION OF THE DRAWINGS

The single FIGURE of the drawing is a vertical sectional view through a portion of a wall constructed according to the present invention.

DESCRIPTION OF A PREFERRED EMBODIMENT

In the drawing, numeral 2 designates what will be referred to herein as half logs. Cores of heartwood resulting from veneer stripping operations are sawed longitudinally to provide the generally semi cylindrical half logs shown having the cylindrically curved outer surfaces 4 and planar inner faces 6. Each half log is then provided with rabbets 8 at the opposed edges of its flat faces. It is to be noted that the provision of the rabbets results in leaving a sharp edge 10. Numeral 12 designates any suitable supporting structure such as a framework or a continuous surface to which the half logs 2 are secured in any suitable manner, thus positioning their flat faces 6 in coplanar relation. Between adjacent half logs 2 there are positioned filler strips 14 having flange portions 16 substantially filling the rabbets 8 previously referred to. Each filler strip 14 is further provided with a longitudinally extending and outwardly projecting central semi cylindrical bead or rib 18. In constructing the wall structure illustrated, a lower half log 2, for example, will be mounted on the supporting structure 12 and fixed in place thereon, then a filler strip 14 will be placed in the upwardly facing rabbet 8 and pushed downwardly into snug engagement with the sharp edge 10 previously referred to. Since the bead 18 is substantially semi cylindrical, the side portions thereof form an inside corner where those beads join the flanges 16, the edge 10 is received in that corner and relatively light lateral pressure jams that edge into the corner and effects a tight and efficient weather seal without the necessity of using any further or additional materials. Construction of the wall then proceeds by placing the next upper half log 2 in position over the upper flange 16 of the previously installed filler strip and pushing the same downwardly so that its lower edge 10 is jammed into the corner previously described. Construction proceeds with the alternate placement of filler strips and half logs until the wall is completed.

If desired, the beads 18 may be colored or otherwise treated to simulate mortar between logs.

While a single specific embodiment of the invention has been shown and described herein, the same is merely illustrative of the principles involved and other forms may be resorted to within the scope of the appended claims.

I claim:

1. In a building wall construction having generally semi cylindrical log members arranged in side-by-side relation with their curved surfaces outwardly and with flat inner surfaces secured to a supporting structure, the improvement comprising:

said log members being rabbeted along the longitudinal edges of their flat inner surfaces; and filler strips extending longitudinally between adjacent log members, said filler strips having flange portions substantially filling said rabbets and having longitudinally extending central beads projecting outwardly in tight abutment with adjacent edges of adjacent log members said beads being of generally semi cylindrical shape and opposite sides thereof at the juncture between said beads and flange portions tightly abutting acute-angled edge portions of said log members with substantially line contact.

2. A construction as defined in claim 1 wherein said log members comprise the heartwood of trees.

* * * * *